US006272297B1

(12) United States Patent
Kobayashi

(10) Patent No.: US 6,272,297 B1
(45) Date of Patent: Aug. 7, 2001

(54) IMAGE PROCESSING APPARATUS HAVING FUNCTION FOR CONTROLLING EJECT SHEETS, AND CONTROL METHOD THEREFOR

(75) Inventor: Yasukazu Kobayashi, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,724

(22) Filed: Feb. 18, 2000

(51) Int. Cl.[7] ..... G03G 15/00

(52) U.S. Cl. ..... 399/82; 271/298; 399/85; 399/405

(58) Field of Search ..... 399/82, 85, 87, 399/45, 389, 391, 405; 271/3, 176, 298, 288

(56) References Cited

U.S. PATENT DOCUMENTS 5,184,734 * 2/1993 Yamaguchi ..... 271/3 X
5,712,713 1/1998 Hamanaka et al. ..... 358/451
5,809,392 * 9/1998 Tabuchi et al. ..... 399/405

* cited by examiner

*Primary Examiner*—Arthur T. Grimley
*Assistant Examiner*—Hoan Tran
(74) *Attorney, Agent, or Firm*—Foley & Lardner

(57) ABSTRACT

In a delivery destination control method of this invention, even when a cardboard mode is instructed first, and then a finishing mode is instructed, the cardboard mode instructed first is preferentially selected and set. Conversely, even when the cardboard mode is instructed first, and then the finishing mode is instructed, the finishing mode instructed first is preferentially selected and set. When the cardboard mode is set, the delivery destination is controlled to a first delivery section, and a change of the delivery destination is inhibited. When the finishing mode is set, the delivery destination is controlled to a second delivery section, and the change of the delivery destination is inhibited.

10 Claims, 4 Drawing Sheets

IMAGE PROCESSING APPARATUS HAVING FUNCTION FOR CONTROLLING EJECT SHEETS, AND CONTROL METHOD THEREFOR

BACKGROUND OF THE INVENTION

The main body delivery tray of a conventional copying machine is attached to the side surface of the copying machine main body. In such conventional copying machine, the main body delivery tray can be detached from the copying machine main body, and a finisher can be attached in place of the main body delivery tray. That is, the delivery destination of the copying machine is set at one of the main body delivery tray and finisher depending on the arrangement of the copying machine.

In this copying machine, not only normal paper but also cardboard can be applied as a copy medium. When cardboard is applied, the toner fixing property can be temporarily improved. Generally, paper conveyability of a copying machine main body is higher than that of a finisher. Hence, the finisher cannot sometimes convey cardboard that can be conveyed in the copying machine without any problem. When cardboard is applied to the copying machine having a finisher, the cardboard may jam in the finisher. To prevent this, when cardboard is applied, the state of the delivery destination of the copying machine must be confirmed. When a finisher is attached to the copying machine, the finisher must be detached from the copying machine main body, and the main body delivery tray must be attached in place to the finisher.

BRIEF SUMMARY OF THE INVENTION

The present invention has been made to solve the above problem, and has as its object to provide the following image forming apparatus and delivery destination control method.

(1) An image forming apparatus and delivery destination control method which can free a user from cumbersome operation of confirming the state of delivery destination or exchanging the delivery destination when cardboard is applied as a copy medium.

(2) An image forming apparatus and delivery destination control method which can set an appropriate delivery destination in correspondence with various modes.

In order to achieve the above object, an image forming apparatus of the present invention comprises a mode setting section for, when modes which cannot be simultaneously executed are simultaneously instructed, selecting and setting only a specific mode of a plurality of instructed modes, an image forming section for forming an image on a medium in correspondence with the mode set by the mode setting section, and a delivery control section for controlling, in correspondence with the mode set by the mode setting section, a delivery destination of the medium having the image formed by the image forming section.

In order to achieve the above object, a delivery destination control method of the present invention comprises the first step of, when modes which cannot be simultaneously executed are simultaneously instructed, selecting and setting only a specific mode of a plurality of instructed modes, and the second step of controlling, in correspondence with the mode set in the first step, a delivery destination of a medium having an image formed by an image forming section.

DETAILED DESCRIPTION OF THE INVENTION

An embodiment of the present invention will be described below with reference to the accompanying drawings.

Figure 1:
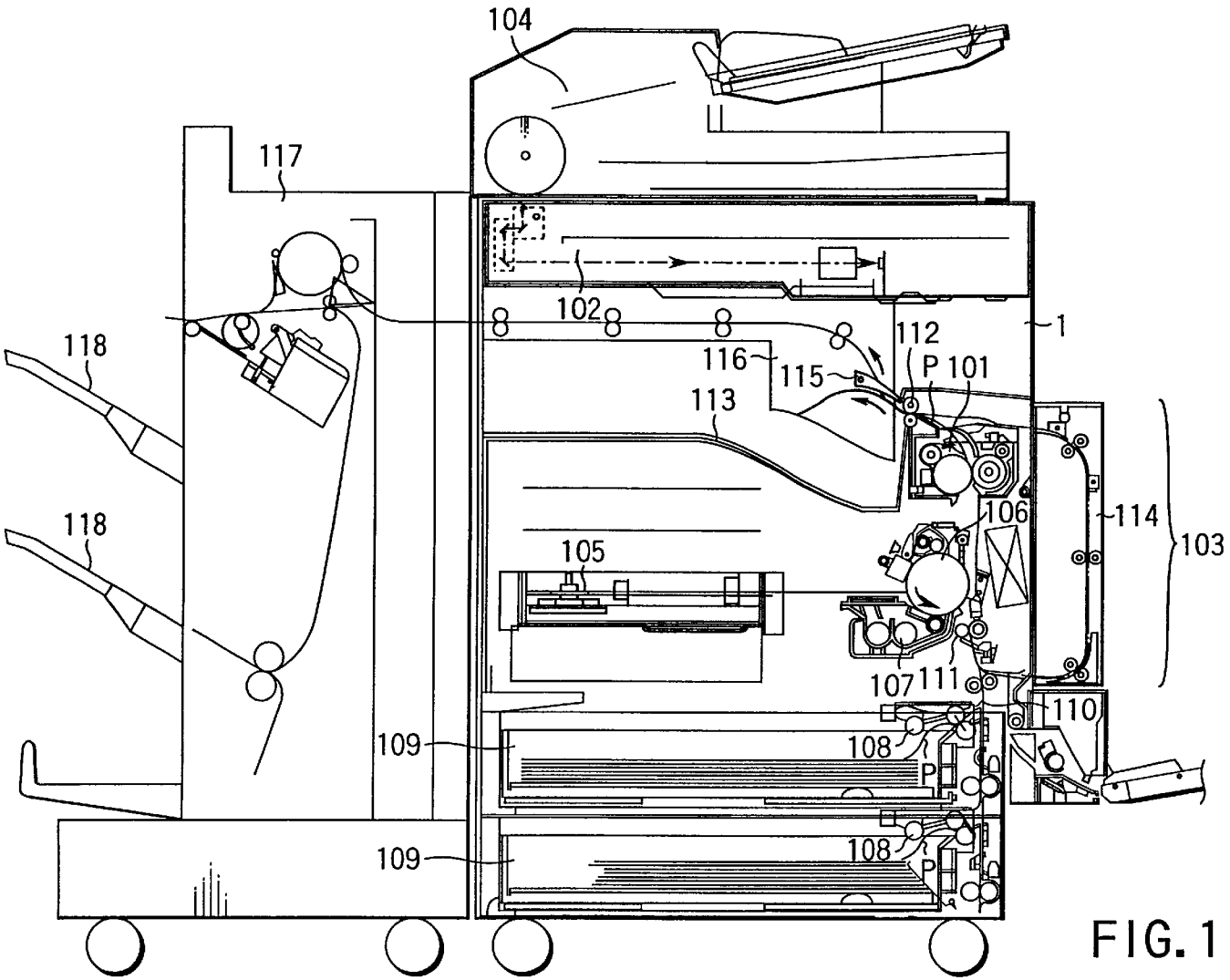
FIG. 1 is a sectional view showing the schematic arrangement of a digital copying apparatus as an example of an image forming apparatus of the present invention.

FIG. 1 is a sectional view showing the schematic arrangement of a digital copying apparatus 1 as an example of an image forming apparatus of the present invention. As shown in FIG. 1, the digital copying apparatus 1 has a scanner 102 for reading image information to be copied as a density pattern of light and generating an image signal, and an image forming section 103 for forming an image corresponding to an image signal supplied externally or from the scanner 102. The scanner 102 integrally has an automatic document feeder (ADF) 104 which sequentially exchanges objects to be copied in synchronism with the image reading operation of the scanner 102 when the objects to be copied have a sheet shape. A finisher 117 is connected to the digital copying apparatus 1. This finisher can be detached from the digital copying apparatus 1.

The image forming section 103 has an exposure unit 105 for emitting a laser beam corresponding to image information supplied externally or from the scanner 102, a photosensitive drum 106 for holding an image corresponding to the laser beam from the exposure unit 105, a developing unit 107 for supplying a developer to the image formed on the photosensitive drum 106 and developing the image, and a fixing unit 101 for heating and fusing a developer image formed by transferring the developer image on the photosensitive drum 106, which is developed by the developing unit 107, to a transfer medium fed by a feeding section (to be described below), and fixing the developer image on the transfer medium.

When image information is supplied externally or from the scanner 102, the photosensitive drum 106 charged to a predetermined potential in advance is irradiated with a laser beam from the exposure unit 105, which is intensity-modulated in accordance with the image information. With this operation, an electrostatic latent image corresponding to the image to be copied is formed on the photosensitive drum 106.

The developing unit 107 selectively provides toner T to the electrostatic latent image formed on the photosensitive drum 106 and develops it, and the toner image is transferred to a paper sheet P as a transfer medium supplied from a cassette (to be described below). The toner T transferred to the paper sheet P is conveyed to the fixing unit 101, and fused and fixed by the fixing unit 101.

The paper sheets P are picked up by pickup rollers 108 one by one from a paper cassette 109 provided under the photosensitive drum 106, passed through a convey path 110 to the photosensitive drum 106, conveyed to aligning rollers 111 for aligning the paper sheet to the toner image (developer image) formed on the photosensitive drum 106, and fed at a predetermined timing to a transfer position where the photosensitive drum 106 opposes the transfer unit.

The paper sheet P on which an image formed from the toner T is fixed by the fixing unit 101 is conveyed to delivery rollers 112. A delivery destination switching guide 115 is provided on the upstream side of the delivery rollers 112. This delivery destination switching guide 115 switches the delivery destination of the paper sheet P between "inside the machine" and "outside the machine". When the delivery destination switching guide 115 switches the delivery destination of the paper sheet P to "inside the machine", the paper sheet P is delivered to a first delivery tray 113 disposed between the scanner 102 and the cassette 109. When the delivery destination switching guide 115 switches the delivery destination of the paper sheet P to "outside the machine", the paper sheet P is conveyed to the finisher 117 through a conveyance unit 116 and delivered to a second delivery tray 118 of the finisher. The paper sheets P conveyed to the finisher 117 are stapled by a stapler prepared in the finisher, as needed.

Between the fixing unit 101 and the cassette 109, a double-side feeding unit 114 for inverting the paper sheet P having an image fixed on one surface, as needed, is provided.

Figure 2:
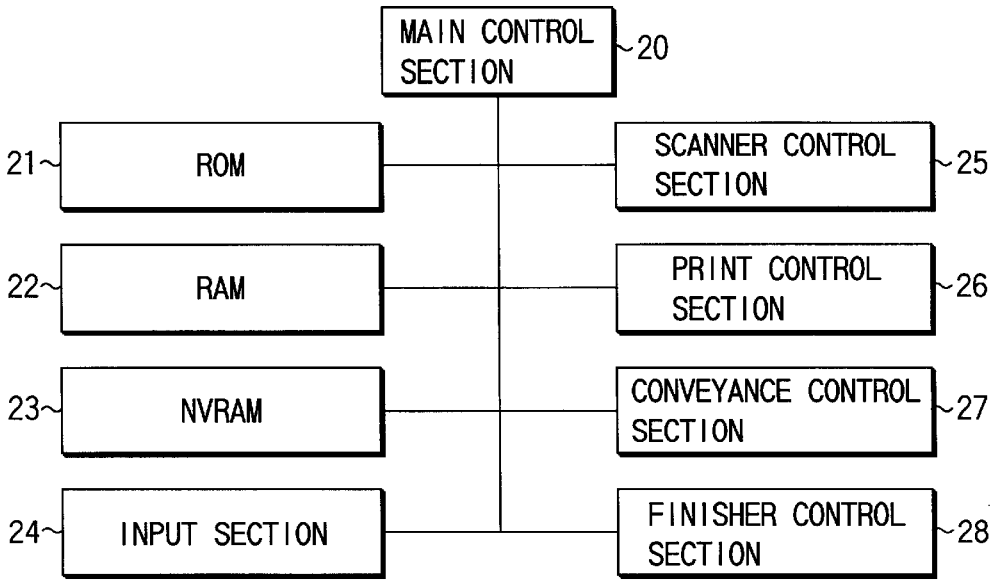
FIG. 2 is a block diagram showing the schematic arrangement of the control system of the digital copying apparatus shown in FIG. 1.

A control system for controlling the digital copying apparatus 1 will be described next with reference to FIG. 2. FIG. 2 is a block diagram showing the schematic arrangement of the control system of the digital copying apparatus 1.

The digital copying apparatus 1 has a main control section 20, ROM 21, RAM 22, NVRAM 23, input section 24, scanner control section 25, image formation control section 26, conveyance control section 27, and finisher control section 28. The main control section 20 controls the entire digital copying apparatus 1. For example, this main control section 20 functions as a delivery control section for controlling the paper delivery destination. The ROM 21 stores the control program of the main control section 20, and the like. The RAM 22 stores necessary data generated by, e.g., operation control of the digital copying apparatus 1. The NVRAM 23 stores data that must be ensured upon power off. The input section 24 corresponding to, e.g., an operation panel receives various inputs to the digital copying apparatus 1 and notifies the main control section 20 of input data. For example, this input section 24 functions as a mode setting section for receiving setting of various modes. The scanner control section 25 controls the operations of the scanner 102 and automatic document feeder 104. The image formation control section 26 controls the operations of apparatuses provided the image forming section 103. The conveyance control section 27 controls conveyance of the paper sheet P. For example, the conveyance control section 27 controls driving of the delivery destination switching guide 115 to control the delivery destination of the paper sheet P (switch the delivery destination of the paper sheet P to the first delivery tray 113 or second delivery tray 118). The finisher control section 28 controls driving the finisher 117.

Figure 3:
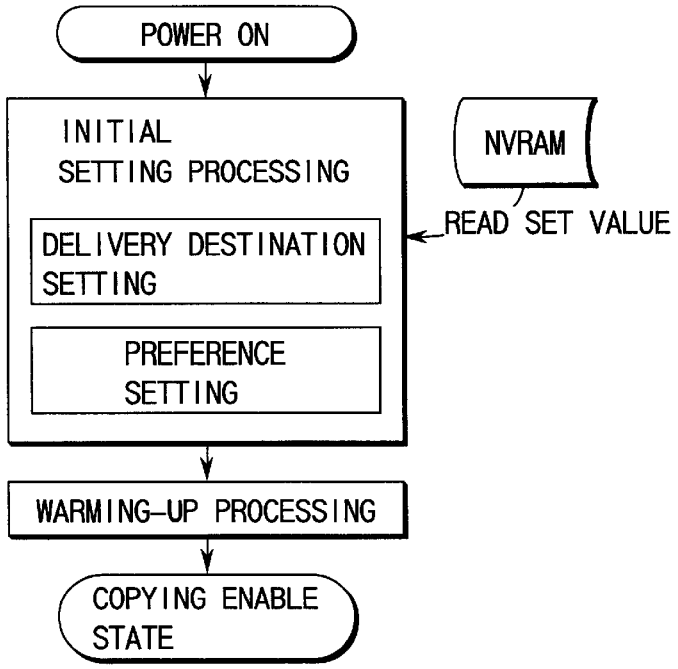
FIG. 3 is a view for explaining initial setting of the digital copying apparatus shown in FIG. 1.

Initial setting of the digital copying apparatus 1 will be described next with reference to FIG. 3. The NVRAM 22 of the digital copying apparatus 1 stores various initial setting data. When the digital copying apparatus 1 is powered on, or an "all clear" instruction is input from the input section 24 of the digital copying apparatus 1, the various initial setting data stored in the NVRAM 22 are read out (initial setting), and warming-up starts to set a copying enable state.

The initial setting data include, e.g., delivery destination setting data and delivery destination valid function setting data. The delivery destination setting data sets the delivery destination of the paper sheet P in accordance with the situation. For example, when the finisher 117 is connected to the digital copying apparatus 1, the delivery destination of the paper sheet P is preferentially set to the second delivery tray 118 (outside the machine) of the finisher 117. When the finisher 117 is disconnected, the delivery destination of the paper sheet P is set to the first delivery tray 113 (inside the machine). When a cardboard mode is instructed from the input section 24, the delivery destination of the paper sheet P is set to the first delivery tray 113 independently of the connection state of the finisher 117. In the cardboard mode, paper thicker than normal paper is employed as the paper sheet P. More specifically, the digital copying apparatus 1 has a plurality of paper cassettes 109. One of the cassettes is used as a paper cassette for cardboard, and cardboard is stored in this paper cassette. When the cardboard mode is designated, the paper cassette storing cardboard is selected, and cardboard stored in the paper cassette is conveyed.

Delivery destination valid function setting data sets valid functions in accordance with the set delivery destination. When the delivery destination of the paper sheet P is set to the first delivery tray 113 inside the machine, functions except a finishing mode that uses the finisher 117 are validated. For example, the cardboard mode is a valid function. Conversely, when the delivery destination of the paper sheet P is set to the second delivery tray 118 of the finisher 117 outside the machine, the finishing mode is validated, and functions incapable of delivery through the finisher 117 are invalidated. For example, the cardboard mode is invalid.

The above settings are merely default settings. Setting of the delivery destination can be changed through the input section 24. When setting of the delivery destination is changed through the input section 24, setting of the delivery destination may be inconsistent with setting of functions. For example, the cardboard mode and finishing mode cannot be simultaneously set. This is because cardboard cannot pass through the finisher 117. If modes that cannot be simultaneously executed are instructed, the digital copying apparatus 1 solves this inconsistency by a means (1) or (2). (1) A mode that has been instructed first is preferentially selected and set (first-mode priority). (2) A mode that has been instructed last is preferentially selected and set (last-mode priority).

Figure 4:
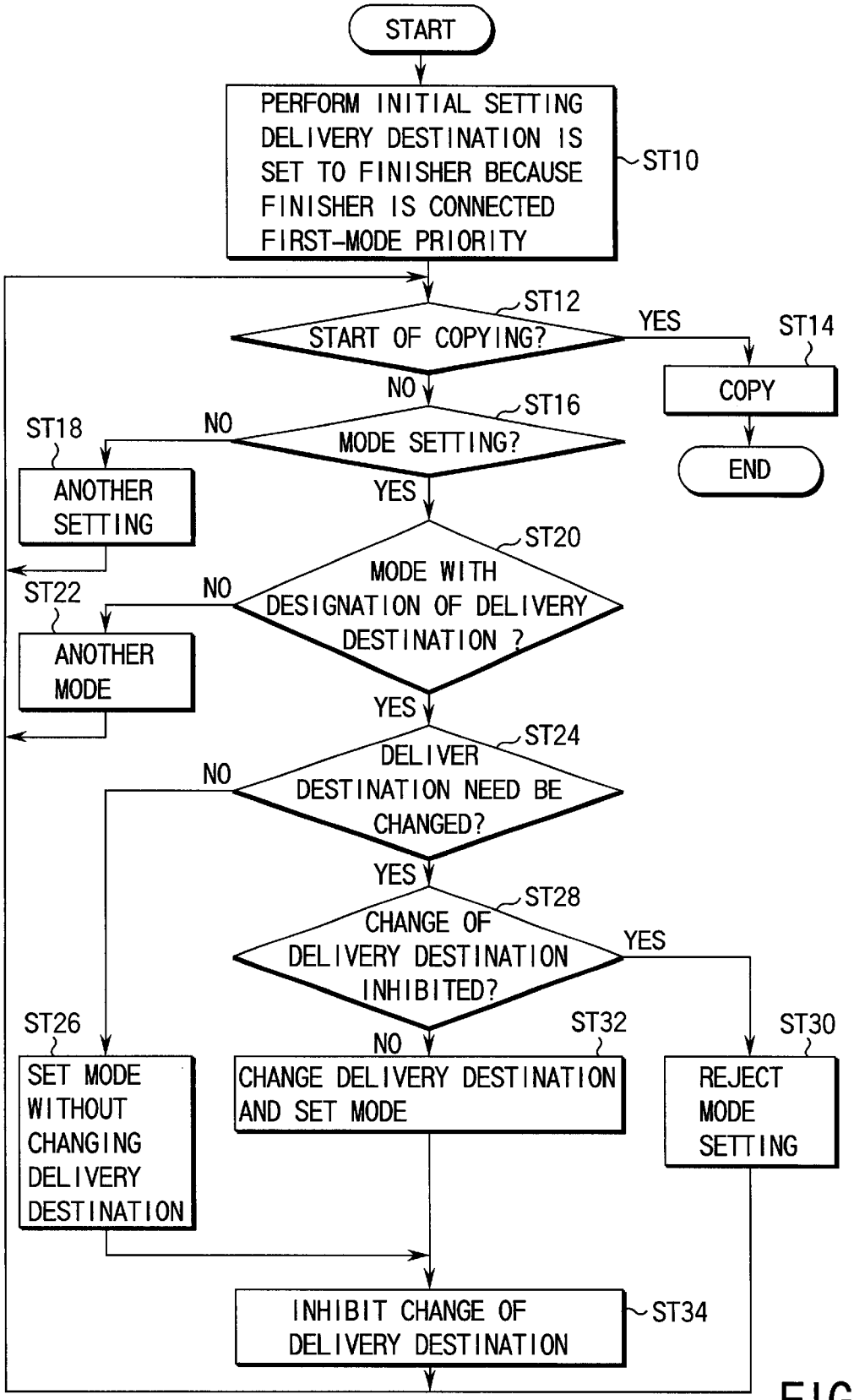
FIG. 4 is a flow chart for explaining first-mode priority processing.

The above "first-mode priority" will be de scribe d next with reference to the flow chart shown in FIG. 4. Assume that the finisher 117 is connected to the digital copying apparatus 1 in advance.

First, initial setting i s done in the digital copying apparatus 1 (ST10). In this case, since "first-mode priority" is set in the digital copying apparatus 1, and the finisher 117 is connected to the digital copying apparatus 1, the second delivery tray 118 of the finisher 117 is set as a delivery destination. When the start of copying is instructed through the input section 24 (ST12, YES), copying starts (ST14), and the paper sheet P is delivered to the second delivery tray 118 of the finisher 117.

Another parameter (e.g., the number of copies) may be set (ST18) without immediately instructing the start of copying (ST12, NO) or instructing mode setting (ST16, NO). Mode setting may be instructed (ST16, YES) without instructing the start of copying (ST12, NO). When setting of a mode without designating any designation of delivery destination is instructed (ST20, NO), the instructed mode is set (ST22).

When setting of a mode with designation of a delivery destination is instructed (ST20, YES), and the delivery destination need not be changed (ST24, NO), the mode is set without changing the delivery destination (ST26). When setting of a mode with designation of a delivery destination is instructed (ST20, YES), the delivery destination need be changed (ST24, YES), and the change of the delivery destination is inhibited (ST28, YES), mode setting instructed in ST20 is rejected (ST30). When setting of a mode with designation of a delivery destination is instructed (ST20, YES), the delivery destination need be changed (ST24, YES), and the change of the delivery destination is not inhibited (ST28, NO), the delivery destination is changed to that required by the mode instructed in ST20, and the mode is set (ST32). After the mode is set (ST26, 32), the change of the delivery destination is inhibited (ST34).

As concrete example 1, a case wherein when "first-mode priority" is being set in the digital copying apparatus 1, the finishing mode is set, and then the cardboard mode is set will be described with reference to the flow chart shown in FIG. 4.

The start of copying is not instructed (ST12, NO), and setting of the finishing mode is instructed (ST16, YES). The instructed mode is a mode that designates the second delivery tray 118 of the finisher 117 as a delivery destination (ST20, YES), and in this case, the delivery destination need not be changed (ST24, NO). Hence, the finishing mode is set without changing the delivery destination (ST26). After that, the change of the delivery destination is inhibited (ST34), and "first-mode priority" (finishing mode) is affirmed.

Next, the start of copying is not instructed (ST12, NO), and setting of the cardboard mode is instructed (ST16, YES). Since the instructed mode is a mode that designates the first delivery tray 113 as a delivery destination (ST20, YES), the delivery destination need be changed (ST24, YES). However, the change of the delivery destination is inhibited (ST28, YES), so setting of the cardboard mode is rejected (ST30). At this time, the user is notified of rejection of setting of the cardboard mode through the display section of the input section 24.

After that, the start of copying is instructed (ST12, YES). Copying starts (ST14) in the finishing mode set first (the delivery destination is the second delivery tray 118).

As concrete example 2, a case wherein when "first-mode priority" is being set in the digital copying apparatus 1, the cardboard mode is set, and then the finishing mode is set will be described with reference to the flow chart shown in FIG. 4.

The start of copying is not instructed (ST12, NO), and setting of the cardboard mode is instructed (ST16, YES). Since the instructed mode is a mode that designates the first delivery tray 113 as a delivery destination (ST20, YES), the delivery destination need be changed (ST24, YES). Since the change of the delivery destination is not inhibited (ST28, NO), the delivery destination is changed to the first delivery tray 113, and the cardboard mode is set (ST32). After that, the change of the delivery destination is inhibited (ST34), and "first-mode priority" (cardboard mode) is established.

Next, the start of copying is not instructed (ST12, NO), and setting of the finishing mode is instructed (ST16, YES). Since the instructed mode is a mode that designates the second delivery tray 118 of the finisher 117 as a delivery destination (ST20, YES), the delivery destination need be changed (ST24, YES). However, the change of the delivery destination is inhibited (ST28, YES), so setting of the finishing mode is rejected (ST30). At this time, the user is notified of rejection of setting of the finishing mode through the display section of the input section 24.

After that, the start of copying is instructed (ST12, YES). Copying starts (ST14) in the cardboard mode set first (the delivery destination is the first delivery tray 113).

Figure 5:
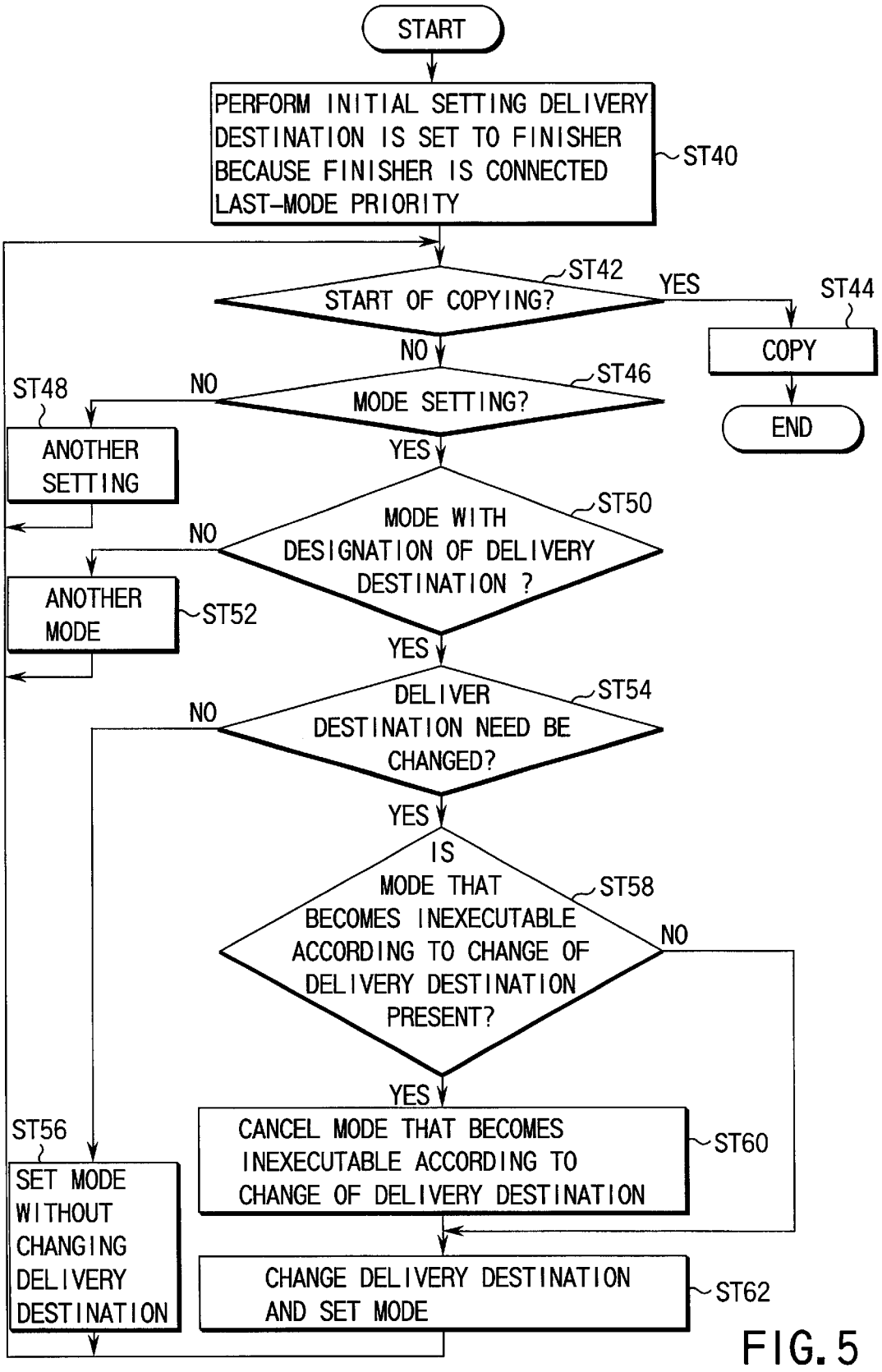
FIG. 5 is a flow chart for explaining last-mode priority processing.

The above "last-mode priority" will be described next with reference to the flow chart shown in FIG. 5. Assume that the finisher 117 is connected to the digital copying apparatus 1 in advance.

First, initial setting is done in the digital copying apparatus 1 (ST40). In this case, since "last-mode priority" is set in the digital copying apparatus 1, and the finisher 117 is connected to the digital copying apparatus 1, the second delivery tray 118 of the finisher 117 is set as a delivery destination. When the start of copying is instructed through the input section 24 (ST42, YES), copying starts (ST44), and the paper sheet P is delivered to the second delivery tray 118 of the finisher 117.

Another parameter (e.g., the number of copies) may be set (ST48) without immediately instructing the start of copying (ST42, NO) or instructing mode setting (ST46, NO). Mode setting may be instructed (ST46, YES) without instructing the start of copying (ST42, NO). When setting of a mode without any designation of a delivery destination is instructed (ST50, NO), the instructed mode is set (ST52).

When setting of a mode with designation of a delivery destination is instructed (ST50, YES), and the delivery destination need not be changed (ST54, NO), the mode is set without changing the delivery destination (ST56). When setting of a mode with designation of a delivery destination is instructed (ST50, YES), the delivery destination need be changed (ST54, YES), and a mode that becomes inexecutable according to the change of the delivery destination has not been set (ST58, NO), the delivery destination is changed to that required by the mode instructed in ST50, and the mode is set (ST62). When setting of a mode with designation of a delivery destination is instructed (ST50, YES), the delivery destination need be changed (ST54, YES), and a mode that becomes inexecutable according to the change of the delivery destination has been set (ST58, YES), setting of the mode that becomes inexecutable according to the change of the delivery destination is canceled (ST60). Then, the delivery destination is changed to that required by the mode instructed in ST50, and the mode is set (ST62). After the mode is set (ST56, 62), the change of the delivery destination is inhibited (ST64).

As concrete example 3, a case wherein when "last-mode priority" is being set in the digital copying apparatus 1, the finishing mode is set, and then the cardboard mode is set will be described with reference to the flow chart shown in FIG. 5.

The start of copying is not instructed (ST42, NO), and setting of the finishing mode is instructed (ST46, YES). The instructed mode is a mode that designates the second delivery tray 118 of the finisher 117 as a delivery destination (ST50, YES), and in this case, the delivery destination need not be changed (ST54, NO). Hence, the finishing mode is set without changing the delivery destination (ST56).

Next, the start of copying is not instructed (ST42, NO), and setting of the cardboard mode is instructed (ST46, YES). Since the instructed mode is a mode that designates the first delivery tray 113 as a delivery destination (ST50, YES), the delivery destination need be changed (ST54, YES). However, the finishing mode that becomes inexecutable according to the change of the delivery destination has been set (ST58, YES). Setting of the finishing mode is canceled (ST60). The delivery destination is changed to the first delivery tray 113 requested by the cardboard mode, and the cardboard mode is set (ST62). At this time, the user is notified of rejection of setting of the finishing mode through the display section of the input section 24.

After that, the start of copying is instructed (ST42, YES). Copying starts (ST44) in the cardboard mode set lastly (the delivery destination is the first delivery tray 113).

As concrete example 4, a case wherein when "last-mode priority" is being set in the digital copying apparatus 1, the cardboard mode is set, and then the finishing mode is set will be described with reference to the flow chart shown in FIG. 5.

The start of copying is not instructed (ST42, NO), and setting of the cardboard mode is instructed (ST46, YES). Since the instructed mode is a mode that designates the first delivery tray 113 as a delivery destination (ST50, YES), the delivery destination need be changed (ST54, YES). A mode that becomes inexecutable according to the change of the delivery destination has not been set (ST58, NO). Hence, the delivery destination is changed to the first delivery tray 113 requested by the cardboard mode, and the cardboard mode is set (ST62).

Next, the start of copying is not instructed (ST42, NO), and setting of the finishing mode is instructed (ST46, YES). Since the instructed mode is a mode that designates the second delivery tray 118 as a delivery destination (ST50, YES), the delivery destination need be changed (ST54, YES). However, the cardboard mode that becomes inexecutable according to the change of the delivery destination has been set (ST58, YES). Setting of the cardboard mode is canceled (ST60). The delivery destination is changed to the second delivery tray 118 requested by the finishing mode, and the finishing mode is set (ST62). At this time, the user is notified of rejection of setting of the cardboard mode through the display section of the input section 24.

After that, the start of copying is instructed (ST42, YES). Copying starts (ST44) in the finishing mode set lastly (the delivery destination is the second delivery tray 118).

According to the present invention, the following image forming apparatus and delivery destination control method can be provided.

(1) An image forming apparatus and delivery destination control method which can free a user from cumbersome operation of confirming the state of delivery destination or exchanging the delivery destination when cardboard is applied as a copy medium.

(2) An image forming apparatus and delivery destination control method which can set an appropriate delivery destination in correspondence with various modes.

What is claimed is:

1. A delivery destination control method for forming an image on a medium in accordance with a mode that is set and controlling a destination to which the medium with the image on it is to be delivered, comprising the steps:

a first step of selecting and setting only a specific mode of a plurality of instructed modes when a cardboard mode for forming an image on cardboard paper and a finishing mode capable of designating paper finishing processing, which cannot be simultaneously executed, are simultaneously instructed; and a second step of controlling the delivery destination of a medium having an image formed by an image forming section in correspondence with the specific mode selected and set in the first step such that when the cardboard mode is set in the first step, the delivery destination of cardboard paper having the image formed by said image forming section is a first delivery section corresponding to delivery of cardboard paper, and when the finishing mode is set in the first step, the delivery destination of normal paper having the image formed by said image forming section is a second delivery section corresponding to finishing processing.

2. A delivery destination control method according to claim 1, characterized in that the first step comprises even when the cardboard mode is instructed first, and then the finishing mode is instructed, preferentially selecting and setting the cardboard mode instructed first, and conversely, when the finishing mode is instructed first, and then the cardboard mode is instructed, preferentially selecting and setting the finishing mode instructed first, and the second step comprises when the cardboard mode is set in the first step, controlling the delivery destination to said first delivery section and inhibiting a change of the delivery destination, and when the finishing mode is set in the first step, controlling the delivery destination to said second delivery section and inhibiting the change of the delivery destination.

3. A delivery destination control method according to claim 1, characterized in that the first step comprises when various modes including the cardboard mode and the cardboard mode are instructed, and the cardboard mode is instructed last, preferentially selecting and setting the cardboard mode instructed last, and conversely, when various modes are instructed, and the finishing mode is instructed last, preferentially selecting and setting the finishing mode instructed last, and the second step comprises when the cardboard mode is set in the first step, controlling the delivery destination to said first delivery section and inhibiting a change of the delivery destination, and when the finishing mode is set in the first step, controlling the delivery destination to said second delivery section and inhibiting the change of the delivery destination.

4. A delivery destination control method for forming an image on a medium in accordance with a mode that is set and controlling a destination to which the medium with the image on it is to be delivered, comprising the steps:

a first step of selecting and setting only a specific mode of a plurality of instructed modes when a plurality of modes are instructed which cannot be simultaneously executed, wherein a mode which is instructed first in the plurality of instructed modes is preferentially selected and set; and a second step of controlling, in accordance with the mode set in the first step, a delivery destination of a medium having an image formed by an image forming section.

5. A delivery destination control method for forming an image on a medium in accordance with a mode that is set and controlling a destination to which the medium with the image on it is to be delivered, comprising the steps:

a first step of selecting and setting only a specific mode of a plurality of instructed modes when a plurality of modes are instructed which cannot be simultaneously executed, wherein a mode which is instructed last in the plurality of instructed modes is preferentially selected and set; and a second step of controlling, in accordance with the mode set in the first step, a delivery destination of a medium having an image formed by an image forming section.

6. An image forming apparatus comprising:

a mode setting section for, when modes which cannot be simultaneously executed are simultaneously instructed, selecting and setting only a specific mode of a plurality of instructed modes, wherein when a cardboard mode for forming an image on cardboard paper and a finishing mode capable of designating paper finishing processing, which cannot be simultaneously executed, are simultaneously instructed, said mode setting section selects and sets one of the modes;

an image forming section for forming an image on a medium in correspondence with the mode set by said mode setting section, wherein said image forming section forms the image on cardboard paper when the cardboard mode is set by said mode setting section, and forms the image on normal paper when the finishing mode is set by said mode setting section; and a delivery control section for controlling, in correspondence with the mode set by said mode setting section, a delivery destination of the medium having the image formed by said image forming section, wherein said delivery control section controls the delivery destination of the cardboard paper having the image formed by said image forming section to a first delivery section corresponding to delivery of cardboard paper when the cardboard mode is set by said mode setting section, and controls the delivery destination of the normal paper having the image formed by said image forming section to a second delivery section corresponding to finishing processing when the finishing mode is set by said mode setting section.

7. An image forming apparatus according to claim 6, characterized in that even when the cardboard mode is instructed first, and then the finishing mode is instructed, said mode setting section preferentially selects and sets the cardboard mode instructed first, and conversely, when the finishing mode is instructed first, and then the cardboard mode is instructed, said mode setting section preferentially selects and sets the finishing mode instructed first, and said delivery control section controls the delivery destination to said first delivery section and inhibits a change of the delivery destination when the cardboard mode is set by said mode setting section, and controls the delivery destination to said second delivery section and inhibits the change of the delivery destination when the finishing mode is set by said mode setting section.

8. An image forming apparatus according to claim 6, characterized in that when various modes including the cardboard mode and the cardboard mode are instructed, and the cardboard mode is instructed last, said mode setting section preferentially selects and sets the cardboard mode instructed last, and conversely, when various modes are instructed, and the finishing mode is instructed last, said mode setting section preferentially selects and sets the finishing mode instructed last, and said delivery control section controls the delivery destination to said first delivery section and inhibits a change of the delivery destination when the cardboard mode is set by said mode setting section, and controls the delivery destination to said second delivery section and inhibits the change of the delivery destination when the finishing mode is set by said mode setting section.

9. An image forming apparatus comprising:

a mode setting section for, when modes which cannot be simultaneously executed are simultaneously instructed, selecting and setting only a specific mode of a plurality of instructed modes, wherein when a plurality of modes are instructed, said mode setting section preferentially selects and sets a mode which is instructed first in the plurality of instructed modes;

an image forming section for forming an image on a medium in correspondence with the mode set by said mode setting section; and a delivery control section for controlling, in correspondence with the mode set by said mode setting section, a delivery destination of the medium having the image formed by said image forming section.

10. An image forming apparatus comprising:

a mode setting section for, when modes which cannot be simultaneously executed are simultaneously instructed, selecting and setting only a specific mode of a plurality of instructed modes, wherein when a plurality of modes are instructed, said mode setting section preferentially selects and sets a mode which is instructed last in the plurality of instructed modes;

an image forming section for forming an image on a medium in correspondence with the mode set by said mode setting section; and a delivery control section for controlling, in correspondence with the mode set by said mode setting section, a delivery destination of the medium having the image formed by said image forming section.

* * * * *